US006802667B2

(12) United States Patent
Baker

(10) Patent No.: US 6,802,667 B2
(45) Date of Patent: Oct. 12, 2004

(54) MATERIAL ANTI-SEGREGATION CURTAIN FOR A PAVER

(75) Inventor: Adrian Baker, Charleston, IL (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 85 days.

(21) Appl. No.: 10/333,157

(22) PCT Filed: May 7, 2001

(86) PCT No.: PCT/US01/40684

§ 371 (c)(1),
(2), (4) Date: Jan. 16, 2003

(87) PCT Pub. No.: WO02/06589

PCT Pub. Date: Jan. 24, 2002

(65) Prior Publication Data

US 2004/0042853 A1 Mar. 4, 2004

Related U.S. Application Data

(60) Provisional application No. 60/218,987, filed on Jul. 17, 2000.

(51) Int. Cl.[7] ..... E01C 19/12
(52) U.S. Cl. ..... 404/101; 404/118
(58) Field of Search ..... 404/101, 102, 404/104, 108, 118, 90, 92

(56) References Cited

U.S. PATENT DOCUMENTS

| | | | | | |
|---|---|---|---|---|---|
| 3,961,493 | A | * | 6/1976 | Nolan et al. | 405/158 |
| 4,124,325 | A | * | 11/1978 | Cutler | 404/75 |
| 4,708,519 | A | * | 11/1987 | Davin et al. | 404/101 |
| 4,749,304 | A | * | 6/1988 | Craig | 404/101 |
| 4,823,366 | A | * | 4/1989 | Williams | 377/2 |
| 5,232,305 | A | * | 8/1993 | Bassett et al. | 404/101 |
| 5,401,115 | A | * | 3/1995 | Musil et al. | 404/72 |
| 5,851,085 | A | * | 12/1998 | Campbell | 404/75 |

* cited by examiner

*Primary Examiner*—Robert E. Pezzuto
*Assistant Examiner*—Alexandra K. Pechhold
(74) *Attorney, Agent, or Firm*—Michael Best & Friedrich LLP

(57) ABSTRACT

An anti-segregation device (10) for preventing segregation of paving material (P) that is applied to a road bed (7) by a paving vehicle (1). The anti-segregation device (10) includes a first end (14) that is connected with the frame (2of the paving vehicle (1) and an opposing end (16) proximal to the road bed (7). The anti-segregation device (10) is configured to substantially contain paving material (P) between the anti-segregation device (10) and a screed (3) on the paving vehicle (1). The anti-segregation device (10) substantially prevents larger material particles from falling, rolling or otherwise moving forwardly from the remainder of the paving material head (H) so as to generally prevent material segregation.

16 Claims, 7 Drawing Sheets

MATERIAL ANTI-SEGREGATION CURTAIN FOR A PAVER

This application claims the benefit of provisional application Ser. No. 60/218,987 filed Jul. 17, 2000

BACKGROUND OF THE INVENTION

The present invention relates to paving vehicles, and more particularly, to paving vehicles having screeds and devices, such as augers, for spreading paving material forwardly of the screeds.

Referring to FIG. 1, a paver vehicle or "paver" 1 generally includes a paver chassis or tractor 2 and a screed 3 for leveling paving material and connected with the chassis 2 so as to be pulled from the rear end 2*b* thereof. A storage bin or hopper 4 for holding a supply of paving material P is typically mounted on the front end 2*a* of the chassis 2 and a conveyor 6, which extends longitudinally on the chassis 2, transports paving material P from the hopper 4 to the rear end 2*b* of the chassis 2. The material P falls off the chassis rear end 2*b* and deposits onto a base surface 7 being paved, such as a roadbed.

An auger 8 is generally disposed between the rear end 2*b* of the chassis 2 and the screed 3 and functions to spread deposited material laterally across the front 3*a* of the screed 3 so as to form a head of material H. The screed 3 is pulled into the head of material H as the paver 1 travels upon the base surface 7 such that portions of the material head H flows under the screed 3 and is leveled, and preferably also compressed, into a mat of material M having a generally uniform thickness. Typically, the paving material P, such as asphalt or cement, is formed of an aggregate of material particles of various sizes and there are generally substantial size differences between the larger and smaller particles.

One problem with such known pavers arises due to the above-noted size differences between the material particles of the head of material H. Larger particles, particularly those particles at the top of the material head H, tend to fall from the head of material H as the paving material P is first deposited and then spread by the auger 8, such that the head H "segregates" or separates into regions of larger particles and smaller particles. The segregation of material particles is increased by the forward movement of the material head H, the head H being pushed along the base surface 7 by the screed 3, such that larger particles tend to accumulate forwardly of the remainder of the head H. With such material segregation, the portions of the material head H that are leveled tend to have a greater than intended proportion of smaller or finer particles, causing the formed material mat M to have less strength than desired.

Therefore, it would be desirable to provide a device for a paver to prevent the segregation of material particles in a head of paving material.

BRIEF DESCRIPTION OF THE SEVERAL VIEWS OF THE DRAWINGS

The foregoing summary, as well as the detailed description of the preferred embodiments of the invention, will be better understood when read in conjunction with the appended drawings. For the purpose of illustrating the invention, there is shown in the drawings, which are diagrammatic, embodiments that are presently preferred. It should be understood, however, that the invention is not limited to the precise arrangements and instrumentalities shown. In the drawings:

FIG. 7 is a side perspective view of the auger assembly and curtain section of FIG. 6.

DETAILED DESCRIPTION OF THE INVENTION

Figure 1:
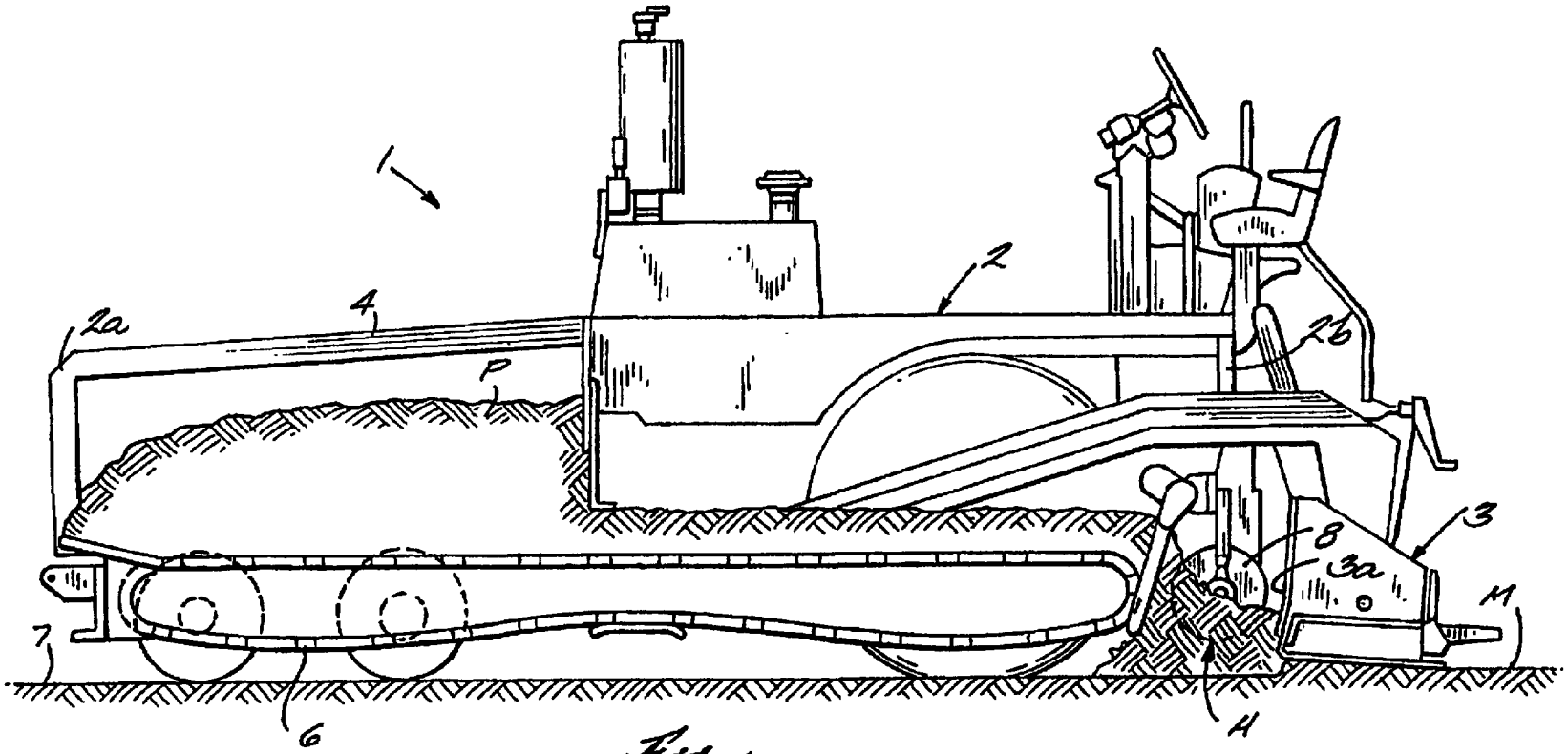
Fig. 1 PRIOR ART
FIG. 1 is a side elevational view of a known paver, depicted engaged in a paving operation.

Referring now to the drawings in detail, wherein like numbers are used to indicate like elements throughout, there is shown in FIGS. 2–7 an anti-segregation device 10 for preventing segregation of paving material P applied to a base surface 7 by a paver 1 having a screed 3. The anti-segregation device 10 basically comprises a barrier 12 having a first end 14 connectable with the paver 1, a second, opposing end 16 disposable against, or at least proximal to, the base surface 7 and a retentive surface 18 located between the first and second ends 14, 16 respectively. The retentive surface 18 faces generally toward the screed 3 when the first end 14 of the barrier 12 is connected with the paver 1 and is configured to substantially contain paving material P between the barrier 12 and the screed 3.

In other words, the retentive surface 18 generally prevents particles of the paving material P from generally separating from the material head H, and in particular, substantially prevents larger material particles from falling, rolling or otherwise moving forwardly from the remainder of the material head H so as to generally prevent material segregation, such segregation being discussed above in the Background section hereof. Preferably, the barrier 12 has a sufficient length such that the retentive surface 18 extends laterally across substantially the entire width W of the screed 3, as discussed below.

Preferably, as shown in FIGS. 4–7, the barrier 12 is constructed as a flexible curtain 22, the curtain 22 preferably including an elongated mounting bar 28 and a plurality of chains 20 spaced across generally the length of the bar 28. Each chain 20 has a first end 21 attached to the bar 28 and a second, free end 23 and is formed of a plurality of links 25 that each provide a separate surface portion of the retentive surface 18. Thus, the retentive surface 18 of the barrier 12 is provided by the total of all the individual link surfaces facing generally toward the screed 3.

Figure 6:
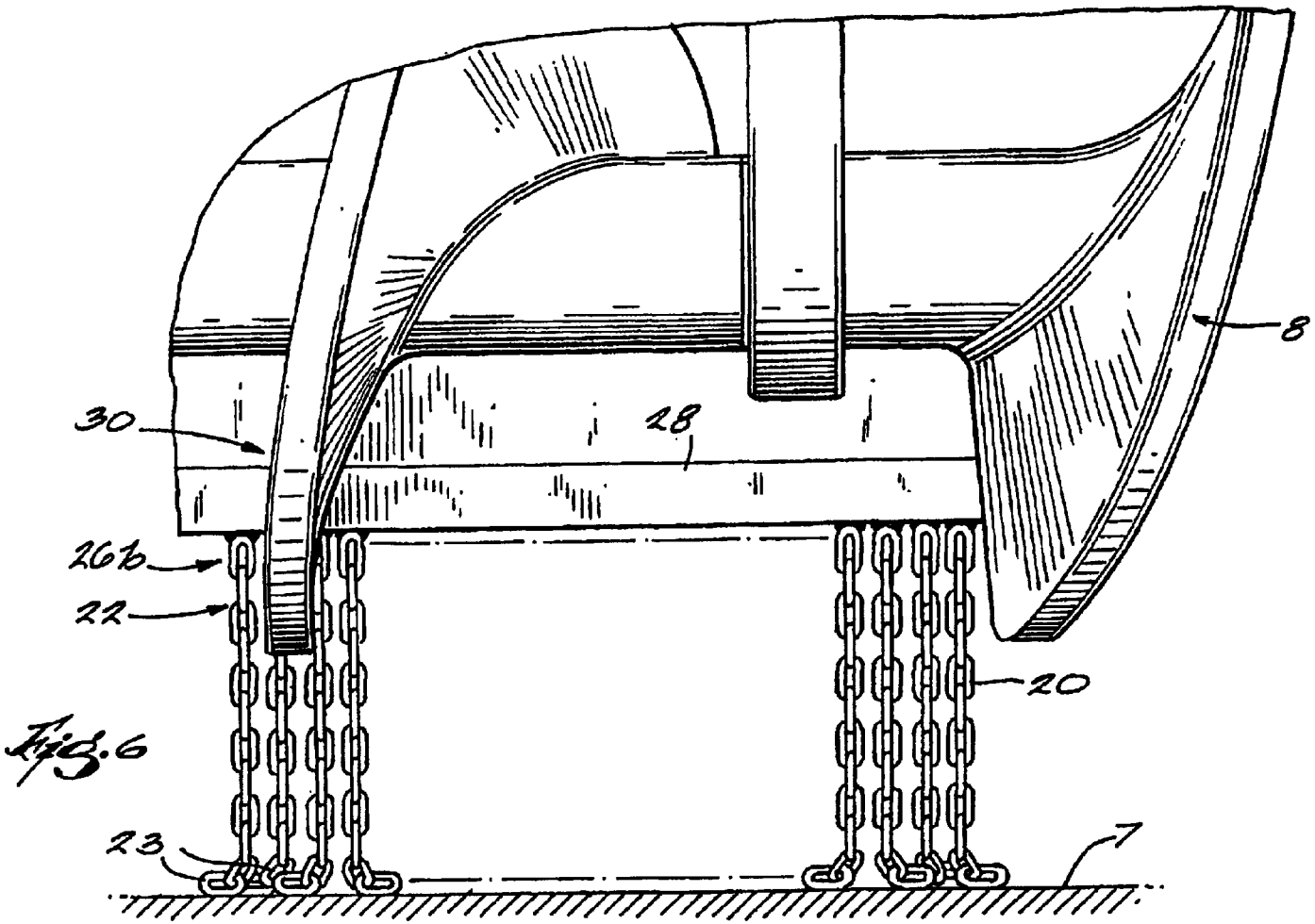
FIG. 6 is a broken-away rear elevational view of an adjustable auger assembly of a paver, showing one flexible curtain section.
Figure 4:
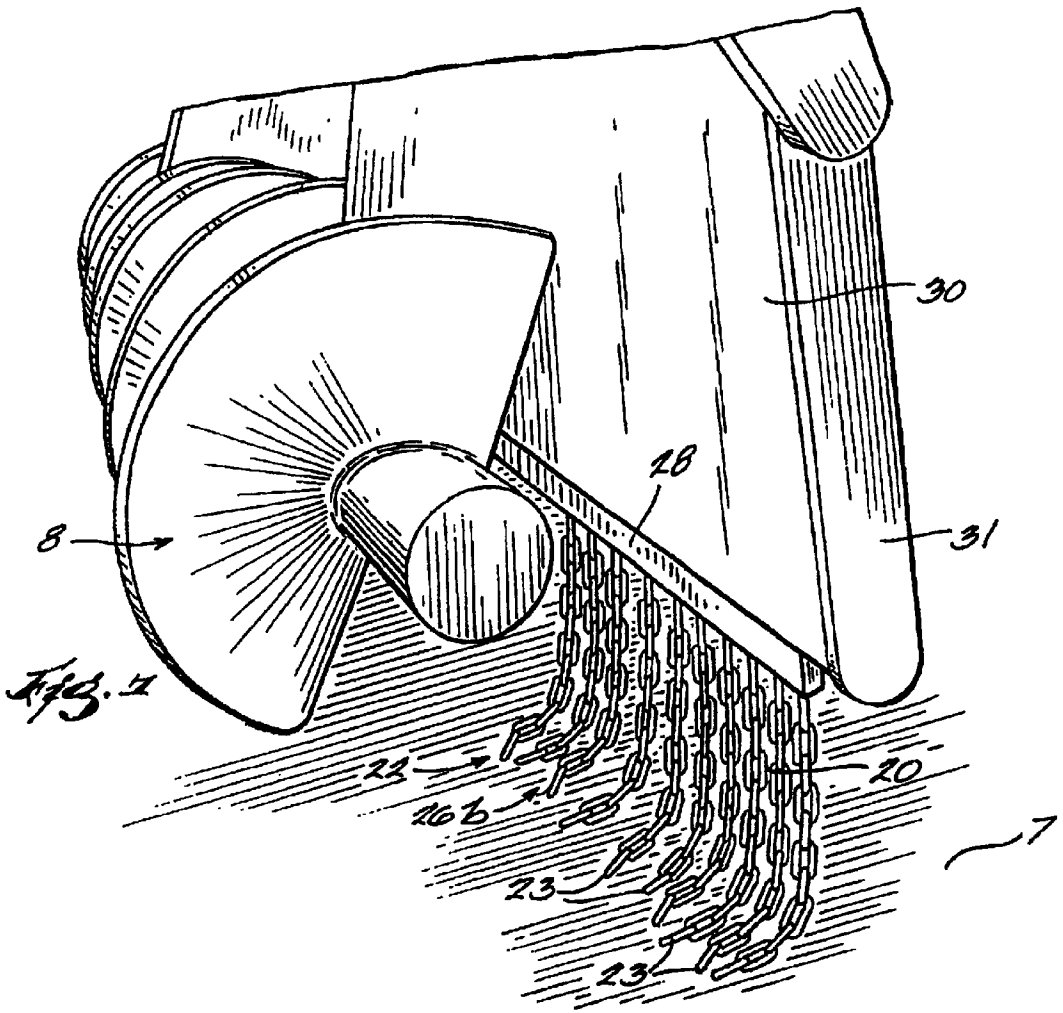

Further, the individual chains 20 are spaced generally close together along the bar 28 so as to provide a more continuous retentive surface 18, as best shown in FIGS. 6 and 7. Alternatively, the curtain 22 may be constructed without the bar 28, with each of the plurality of chains 20 being separately and directly attached to a portion of the paver 1 (e.g., chassis rear wall 34).

Preferably, each chain 20 has sufficient length such that a portion of the chain 20 at the lower chain end 23 is disposed upon the base surface 7 when the paver chassis 2 is generally horizontal on the base surface 7, as best shown in FIGS. 6 and 7. As such, if the paver 1 tilts forwardly when traversing the base surface 7, the lower chain ends 23, collectively forming the lower end 16 of the barrier 12, remain in contact with the base surface 7 to prevent particles of paving material from passing under the retentive surface 18. Further, by being formed as a flexible curtain 22 of chains 20, if the paver 1 tilts rearwardly upon the base surface 7, such as when the chassis front end 2*a* is moving upwardly over a bump or other obstruction, the lower end 16 of the barrier 12 is able to flex or bend against the base surface 7 without being damaged.

Further, the mounting bar 28 is connectable with a portion of the paver 1 so as to extend generally laterally in a direction across the width of the paver 1. The mounting bar 28 may be permanently affixed to a section of the paver 1, such as by welding, riveting, etc., or may be demountably attached thereto, such as by using threaded fasteners, clamps, etc.

With a paver 1 having a height-adjustable, telescoping auger 8 (including an auger box 30 and extendable shields 31) and/or screed end gates 27, the barrier 12 is preferably constructed of a plurality of separate curtain sections 26, and most preferably five curtain sections 26*a*, 26*b* and 26*c*, each having a separate mounting bar 28 and a separate group of chains 20 and being arranged as follows. A first, central curtain section 26*a* (FIG. 4) is attached to the lower end of the rear wall 34 of the paver chassis 2, two intermediate sections 26*b* are each attached to the lower end of a separate one of the two auger boxes 30 and the auger shields 31, and two outer curtain sections 26*c* (FIG. 3—one shown) are each attached to a separate one of the two end gates 27 mounted to each lateral side of the screed 3. By having such an arrangement, the barrier 12 is collectively formed of the several curtain sections 26 and extends across substantially the entire width of the screed 3 of the paver 1, and therefore across the entire lateral-extending length of the head of material H. Alternatively, particularly if the paver 1 does not have a telescoping auger(s), the barrier 12 may be formed of only a single flexible curtain 22, or may formed of any desired number of curtain sections 26.

Further, with the above-discussed arrangement of the barrier 12, the auger 8 is disposed generally between the anti-segregation device 10 and the screed 3, thus containing the head of material H generally about the auger 8. However, if the paver 1 does not include an auger 8 or other such device for laterally distributing the paving material P, the barrier 12 is attached to the rear wall 34 of the chassis 2, and if appropriate, to the screed end gates 27, so as the generally contain the head of material H between the barrier 12 and the screed 3.

Although the flexible curtain 22 is preferably formed of a plurality of individual chains 20, the curtain 22 may alternatively be formed from other types of flexible strands, such as a plurality of wire cables (not shown), one or more sheets of a mesh-like material (not shown), such as for example a section(s) of "chicken wire" or a sheet(s) of cross-connected links, or from one or more sheets of a thin, bendable material (not shown).

Furthermore, the barrier 12 may even be formed of one or more generally rigid plates (not shown) having an upper end connected with the paver 1 and a lower end spaced above and proximal to the base surface 7. However, with such a barrier construction, the barrier lower end 16 is unable to flex when contacting the base surface 7 and may become permanently deformed, or otherwise damaged, if the paver 1 tilts rearwardly during a paving operation.

Figure 2:
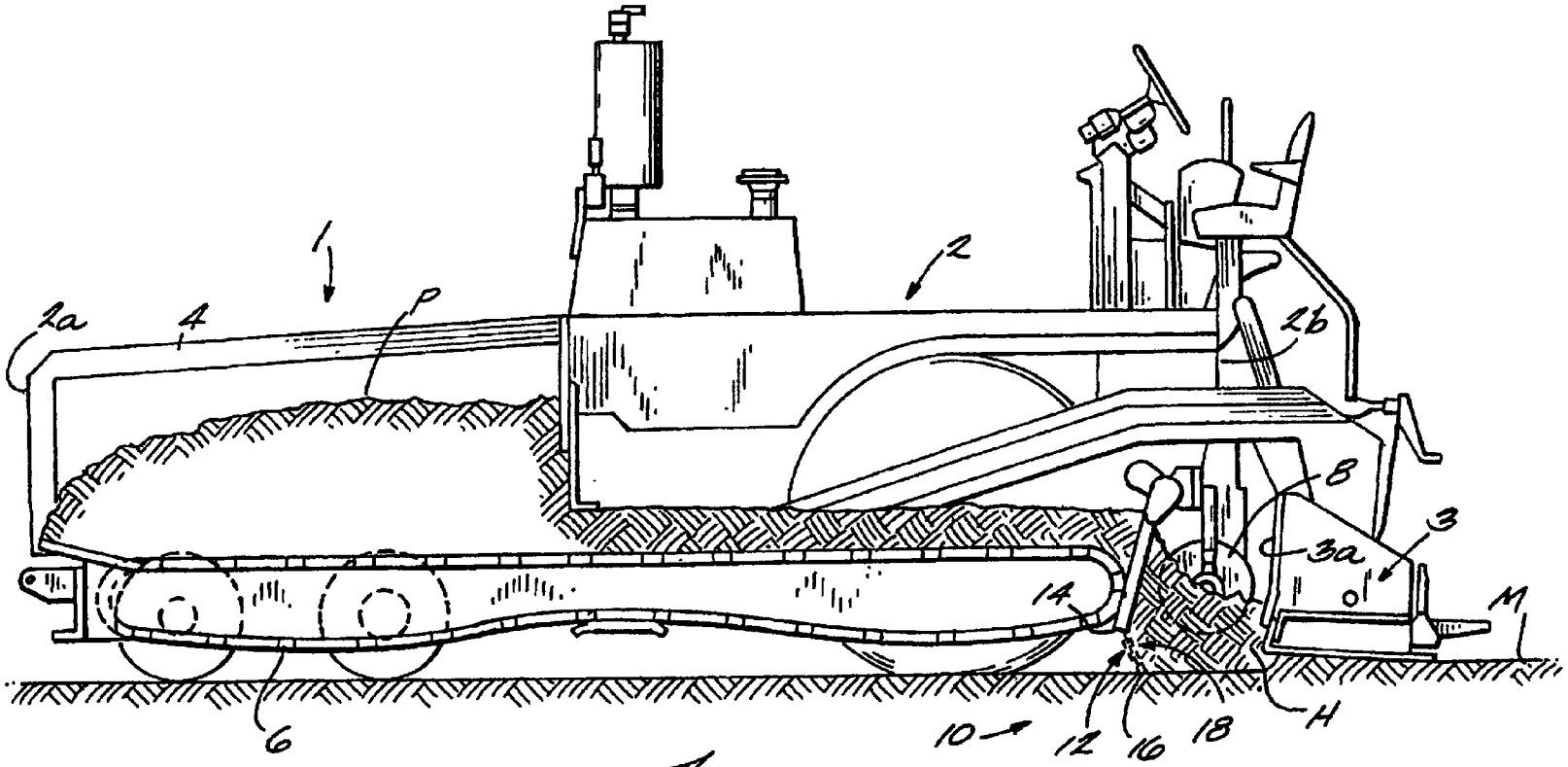
FIG. 2 is a side elevational view of a known paver having an anti-segregation device in accordance with the present invention, depicted engaged in a paving operation.
Figure 3:
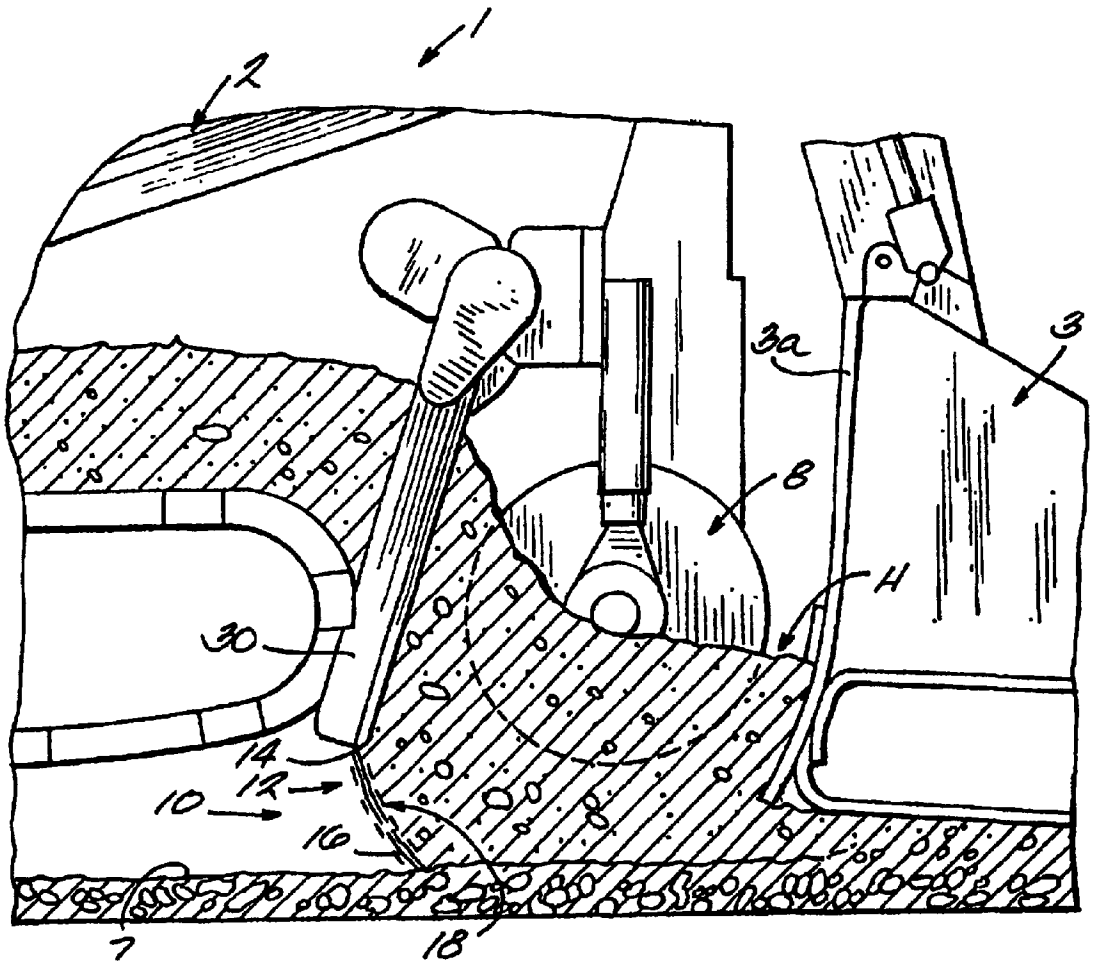
FIG. 3 is an enlarged, broken-away side elevational view of the paver and anti-segregation device shown in FIG. 2.
Figure 4:
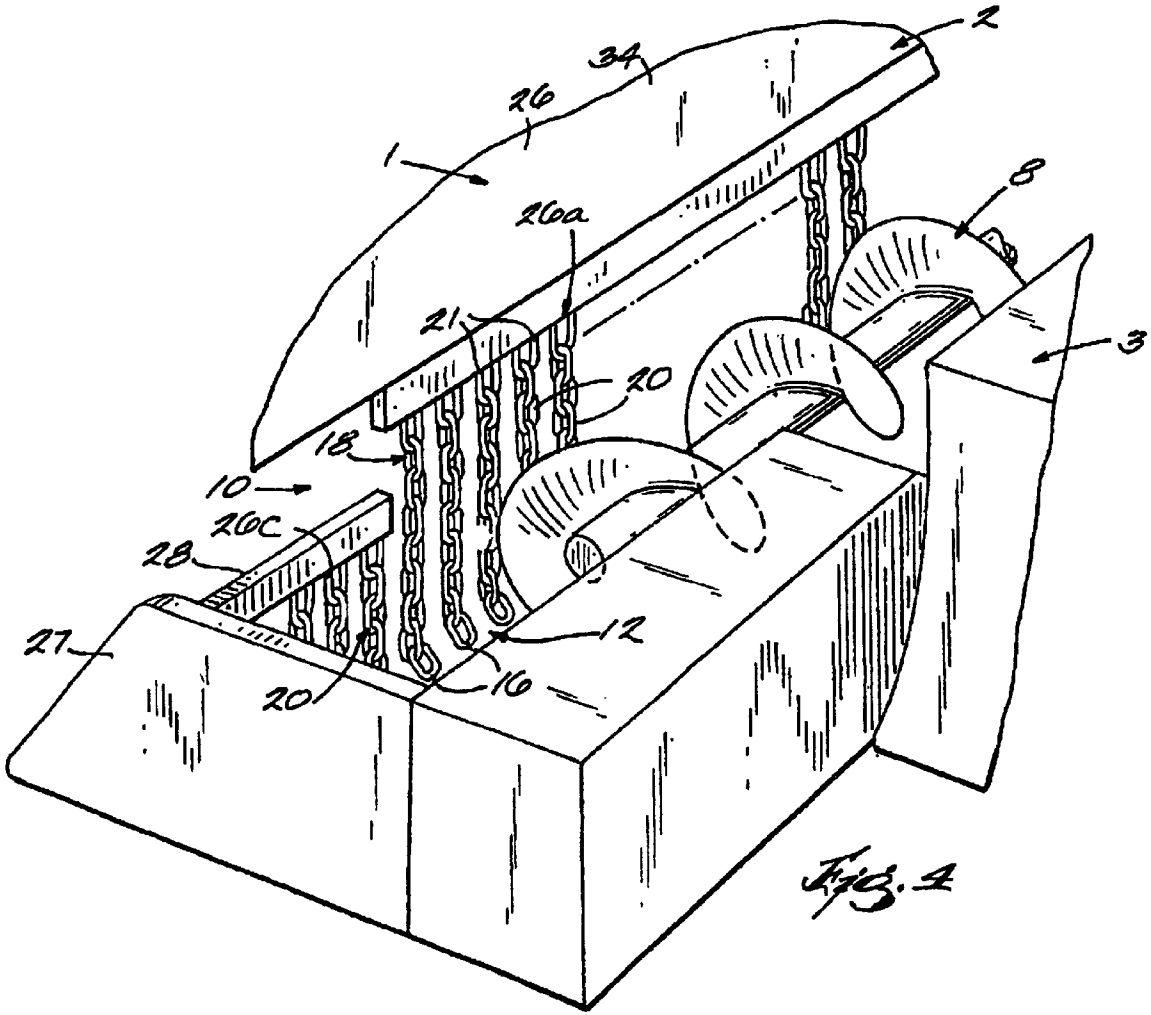
FIG. 4 is a more diagrammatic, broken-away rear perspective view of the paver and the anti-segregation device.
Figure 5:
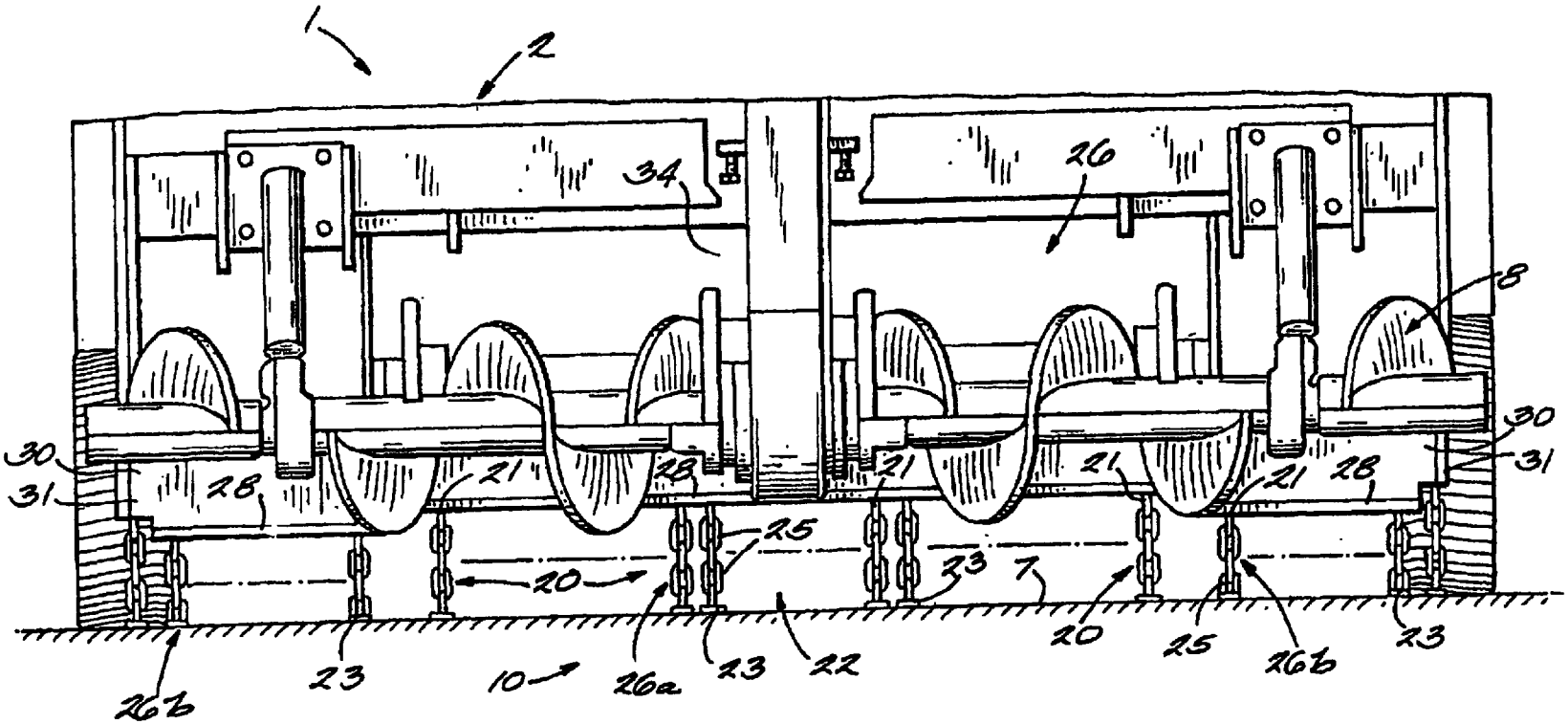
FIG. 5 is a broken-away, rear elevational view of the paver and the anti-segregation device.

Referring to FIGS. 2 and 3, in use, a paver 1 having an anti-segregation device 10, as described above, moves forwardly upon a base surface 7 such that the chassis 2 pulls the screed 3 into the head of material H and the mat M is formed thereby. The conveyor 6 continuously transports paving material P from the hopper 4 to deposit off of the chassis 3 to be distributed by the auger 8, such that the head of material H contains a generally consistent mass of material. The particles of the head of material H are imparted with momentum from being pushed by the forward moving screed 3, from contact with the rotating auger 8 and/or from being "flung" rearwardly off of the conveyor 6.

The particles that move generally forwardly relative to the remainder of the head H impact against the retentive surface 18 of the barrier 12 and are thereby generally prevented from any further relative forward movement. Therefore, the larger particles of paving material are prevented from separating from the material head H, such that material segregation is substantially prevented by the anti-segregation device 10.

What is claimed is:

1. A paving vehicle for spreading paving material onto a road bed, the paving vehicle comprising:

a frame having a front end and a rear end;

a screed for leveling the paving material, the screed being connected with the frame so as to be pulled from the rear end of the frame and having a front surface;

an auger positioned forwardly of the screed and configured to spread the paving material along the front surface of the screed; and an anti-segregation device positioned near the auger for preventing segregation of the paving material disposed on the road bed in front of the screed, the anti-segregation device including a flexible curtain having an upper end attached to the frame, a lower end contactable with the road bed and a retentive surface facing generally toward the screed, the retentive surface being configured to generally contain the paving material between the curtain and the screed, the curtain being bendable at a plurality of positions spaced vertically between the upper and lower ends of the curtain, the flexible curtain including a plurality of chains attached to the frame of the paving vehicle.

2. The paving vehicle of claim 1 wherein the flexible curtain extends laterally across substantially an entire width of the screed.

3. The paving vehicle of claim 1 wherein the flexible curtain includes an elongated mounting bar connected with the frame, the plurality chains being attached to and spaced across along the length of the mounting bar.

4. The paving vehicle of claim 3 wherein the mounting bar extends laterally across the frame of the paving vehicle.

5. The paving vehicle of claim 3 wherein each chain includes an end attached to the mounting bar and an opposing free end.

6. The paving vehicle of claim 5 wherein the chains are spaced close together along the bar so as to provide a continuous retentive surface for the paving material.

7. The paving vehicle of claim 1 wherein each of the chains includes a lower end that is contactable with the road bed.

8. The paving vehicle of claim 7 wherein the lower ends of the chains remain in contact with the road bed when the paving vehicle moves upwardly over an obstruction.

9. The paving vehicle of claim 7 wherein the chains are each adapted to flex against the road bed without being damaged.

10. The paving vehicle of claim 7 wherein each chain includes a plurality of links.

11. The paving vehicle of claim 1 wherein the anti-segregation device includes a plurality of separate curtain sections, each of the curtain sections being mounted to the frame by a separate mounting bar.

12. The paving vehicle of claim 11 wherein the plurality of curtain sections are spaced apart so as extend across substantially an entire width of the screed.

13. The paving vehicle of claim 1 wherein the auger is a telescoping auger that includes a main section and at least one extension section and the flexible curtain extends along the entire auger.

14. A paving vehicle for spreading paving material onto a road bed, the paving vehicle comprising:

a frame having a front end and a rear end;

a hopper for holding a supply of paving material, the hopper being mounted on the front end of the frame;

a conveyor which extends longitudinally on the frame and transports the paving material from the hopper to the rear end of the frame where the paving material falls off the rear end of the frame onto the road bed;

a screed for leveling paving material, the screed being connected with the frame so as to be pulled from the rear end of the frame; and an anti-segregation device positioned near the screed for preventing segregation of the paving material that is positioned on the road bed in front of the screed, the anti-segregation device including a flexible curtain having a first end that is secured to the frame of the paving vehicle and a second end that is proximal to the road bed, the flexible curtain including an elongated mounting bar that extends laterally across the frame and a plurality of chains spaced close together across along the length of the mounting bar to provide a continuous retentive surface for the paving material.

15. The paving vehicle as recited in claim 1 wherein the flexible curtain is separately bendable at a position located proximal to the vehicle frame and at position located proximal to the road bed.

16. An anti-segregation device for a paving vehicle for spreading paving material onto a base surface, the paving vehicle including a frame having a rear end, a screed connected with the frame so as to be pulled from the frame rear end and an auger positioned forwardly of the screed and configured for spreading paving material, the anti-segregation device comprising:

a flexible curtain having a first end connected with the paving vehicle frame, a second end disposed proximal to the base surface and a retentive surface facing generally toward the screed, the retentive surface being configured to generally contain the paving material between the curtain and the screed, the flexible curtain being formed of a plurality of elongated flexible members connected with and spaced along the vehicle frame, each flexible member being one of a chain, a wire rope and a cable.

* * * * *